US006412171B1

(12) United States Patent
Kato et al.

(10) Patent No.: US 6,412,171 B1
(45) Date of Patent: Jul. 2, 2002

(54) SWASH PLATE TYPE COMPRESSOR PISTON WHEREIN INNER BOTTOM SURFACE OF HOLLOW HEAD SECTION HAS 3-DIMENSIONAL CONFIGURATION NONAXISYMMETRIC WITH RESPECT TO ITS CENTERLINE

(75) Inventors: Takayuki Kato; Masato Takamatsu, both of Kariya (JP)

(73) Assignees: Kabushiki Kaisha Toyoda Jidoshokki Seisakusho, Kariya; Altex Co., Ltd., Hamakita, both of (JP)

( * ) Notice: Subject to any disclaimer, the term of this patent is extended or adjusted under 35 U.S.C. 154(b) by 0 days.

(21) Appl. No.: 09/666,961

(22) Filed: Sep. 20, 2000

(30) Foreign Application Priority Data

Sep. 21, 1999 (JP) ..... 11-267131

(51) Int. Cl.[7] ..... B23P 15/00

(52) U.S. Cl. ..... 29/888.04; 29/888.022; 29/888.02

(58) Field of Search ..... 29/888.047, 888.022, 29/888.02; 92/172, 176, 155, 248, 71; 123/193.6, 193.4, 193.2; 164/47, 476, 131, 119, 98

(56) References Cited

U.S. PATENT DOCUMENTS 4,270,255 A * 6/1981 Klimek ..... 29/888.044
4,453,300 A * 6/1984 Klimek et al. ..... 29/888.044
4,505,016 A * 3/1985 Roberts ..... 164/98
4,548,254 A * 10/1985 Roberts ..... 164/98
5,216,943 A * 6/1993 Adler et al. ..... 29/888.047
5,301,599 A * 4/1994 Dearnley et al. ..... 29/888.044
5,630,353 A * 5/1997 Mittlefehldt et al. ..... 92/71
5,868,556 A * 2/1999 Umemura ..... 417/269
6,123,009 A * 9/2000 Kanayame et al. ..... 92/71
6,178,746 B1 * 1/2001 Thoma et al.
6,192,784 B1 * 2/2001 Kato et al. ..... 92/71
6,283,012 B1 * 9/2001 Kato et al. ..... 92/155
6,289,785 B1 * 9/2001 Ikeda et al. ..... 92/71

FOREIGN PATENT DOCUMENTS

JP A-9-79137 3/1997
JP A-9-144654 6/1997
JP A-9-256952 9/1997

OTHER PUBLICATIONS

U.S. application No. 09/666148 filed Sep. 2000.
U.S. application No. 09/666523 filed Sep. 2000.

* cited by examiner

*Primary Examiner*—I Cuda Rosenbaum
(74) *Attorney, Agent, or Firm*—Woodcock Washburn LLP

(57) ABSTRACT

A method of producing a body member for a swash plate type compressor piston, the body member including a head section and an engaging section formed integrally with the head section, comprising the steps of preparing a die-casting device including a casting mold consisting of two mold halves which are spaced apart from each other and butted together in a direction perpendicular to a centerline of the head section and which have respective molding surfaces; and a slide core which is slidably movable in a direction parallel to the centerline such that the slide core is advanced into and retracted from the casting mold, the slide core cooperating with the molding surfaces to define therebetween a mold cavity when the slide core is advanced into the casting mold, the mold cavity having a configuration following that of the body member, at least a front end portion of the slide core having a nonaxisymmetric configuration with respect to a centerline of the slide core; and die-casting the body member using the die-casting device, such that the head section has an inner bottom surface having a three-dimensional configuration nonaxisymmetric with respect to the centerline of the head section corresponding to the nonaxisymmetric configuration of the front end portion of the slide core.

9 Claims, 12 Drawing Sheets

SWASH PLATE TYPE COMPRESSOR PISTON WHEREIN INNER BOTTOM SURFACE OF HOLLOW HEAD SECTION HAS 3-DIMENSIONAL CONFIGURATION NONAXISYMMETRIC WITH RESPECT TO ITS CENTERLINE

This application is based on Japanese Patent Application No. 11-267131 filed Sep. 21, 1999, the contents of which are incorporated hereinto by reference.

BACKGROUND OF THE INVENTION

1. Field of the Invention

The present invention relates in general to a method of producing a body member for a piston for a swash plate type compressor, and more particularly to a method of producing, by die-casting, such a body member having a hollow cylindrical head portion.

2. Discussion of the Related Art

A swash plate type compressor is adapted to compress a gas by a plurality of pistons which are reciprocated by a rotary movement of a swash plate. In general, the piston includes a head portion slidably fitted in a cylinder bore formed in a cylinder block of the compressor, and an engaging portion which slidably engages the swash plate. For reducing the weight of the piston, it has been proposed to form the piston with a hollow cylindrical head section. As one example of the method of producing such a piston, the assignee of the present invention proposed in JP-A-11-152239 a method of producing a blank for the piston, comprising the steps of: preparing a body member including a hollow head section which is closed at one of its opposite ends and is open at the other end, and an engaging section which is formed integrally with the head section; and fixing a closing member prepared separately from the body member, to the body member so as to close the open end of the head section. While the closing member may be produced by any method, the body member is preferably produced by die-casting.

SUMMARY OF THE INVENTION

The present invention was made in the light of the background art described above. It is an object of the present invention to provide an improved method of producing, by die-casting, a body member for a swash plate type compressor piston, which body member includes a hollow cylindrical head section closed at one of its opposite ends, and an engaging section integrally formed with the head section.

The object indicated above may be achieved according to any one of the following forms or modes of the present invention, each of which is numbered like the appended claims and depend from the other form or forms, where appropriate, to indicate and clarify possible combinations of technical features of the present invention, for easier understanding of the invention. It is to be understood that the present invention is not limited to the technical features and their combinations described below. It is also to be understood that any technical feature described below in combination with other technical features may be a subject matter of the present invention, independently of those other technical features.

(1) A method of producing a body member of a piston for a swash plate type compressor, the body member including a generally hollow cylindrical head section having a closed end and an open end which is closed by a closing member so as to provide a head portion of the piston, and an engaging section which is formed integrally with a bottom portion of the hollow cylindrical head section which is located at the closed end, the engaging section giving an engaging portion of the piston for engagement with a swash plate of the compressor, comprising the steps of preparing a die-casting device including a casting mold consisting of two mold halves which are spaced apart from each other and butted together in a direction perpendicular to a centerline of the hollow cylindrical head section, the two mold halves having respective molding surfaces; and a slide core which is slidably movable in a direction parallel to the centerline such that the slide core is advanced into and retracted from the casting mold, the slide core cooperating with the molding surfaces of the mold halves to define therebetween a mold cavity when the slide core is advanced into the casting mold, the mold cavity having a configuration following that of the body member which includes the hollow cylindrical head section and the engaging section, at least a front end portion of the slide core having a nonaxisymmetric configuration with respect to a centerline of the slide core; and die-casting the body member using the die-casting device, such that the hollow cylindrical head section has an inner bottom surface having a three-dimensional configuration which is nonaxisymmetric with respect to the centerline of the hollow cylindrical head section corresponding to the nonaxisymmetric configuration of the front end portion of the slide core.

In the method according to the above mode (1) of this invention, when the slide core is advanced into the casting mold consisting of the two mold halves, the slide core cooperates with the molding surfaces of the two mold halves to define therebetween a mold cavity having a configuration following that of the body member which includes the hollow head section and the engaging section. The mold cavity is filled with a molten metal, so that the intended body member is formed in the mold cavity. Thereafter, the slide core is retracted out of the formed hollow cylindrical head section so that the front end portion of the slide core is located outside the casting mold. Subsequently, the two mold halves are moved apart from each other to remove the formed body member therefrom. In the present arrangement wherein at least the front end portion of the slide core has a nonaxisymmetric configuration with respect to its centerline, the formed hollow cylindrical head section has an inner bottom surface which has a three-dimensional configuration which is nonaxisymmetric with respect to its centerline, which configuration corresponds to the nonaxisymmetric configuration of the front end portion of the slide core.

For reducing the weight of the piston, the hollow cylindrical head section of the body member may be subjected to a machining operation such as a cutting operation effected on its inner circumferential surface prior to fixing the closing member to the open end of the head section. When the inner bottom surface of the head section is subjected to the cutting operation concurrently with the cutting operation on the inner circumferential surface of the head section, the inner bottom surface preferably has a configuration defined by a plurality of circles concentric with the head section, that is, coaxial with a cutting tool used in the cutting operation.

However, in order to minimize the weight of the body member wherein the engaging section is integral with the bottom portion of the head section, the inner bottom surface of the head section preferably has a configuration other than that described above.

By effecting another cutting operation on the inner bottom surface of the head section using a drill or an end mill, in addition to the above-described cutting operation on the inner circumferential surface of the head section, the inner bottom surface of the head section can be formed into a three-dimensional configuration which is different from the above-described configuration defined by a plurality of circles concentric with the head section. This additional step, however, inevitably pushes up the cost of manufacture of the piston.

According to the method of the present invention, in contrast, the inner bottom surface of the head section of the body member can be formed into a desired three-dimensional configuration. In other words, the inner bottom surface of the head section may have any configuration, provided that the slide core can be easily retracted from the formed body member. In the present method, the inner bottom surface of the head section has the three-dimensional configuration which is effective to reduce the weight of the body member including the head section and the engaging section formed integrally with the bottom portion of the head section.

The above description is based on an assumption that the inner circumferential surface of the head section of the body member is subjected to a machining operation such as a cutting operation for reducing the weight of the piston. However, the inner surface of the head section, which includes the inner circumferential surface and the inner bottom surface, need not be machined. When the body member whose hollow cylindrical head section has a sufficiently reduced cylindrical wall thickness can be formed by die-casting, the cutting operation on the inner circumferential surface of the head section can be eliminated.

(2) A method according to the above mode (1), the engaging section is a generally U-shaped section having a base section which extends, in a direction substantially parallel to the centerline of the head section, from a predetermined circumferential portion of the bottom portion of the head section, the circumferential portion being offset from the centerline of the head section, and a pair of parallel arm sections which extend from the base section in the direction substantially perpendicular to the centerline of the head section, the slide core being formed with a protrusion which protrudes, in the direction parallel to the centerline of the head section, from a predetermined circumferential portion of the front end of the slide core which corresponds to the base section of the engaging section.

When the U-shaped engaging section is formed integrally with the bottom portion of the head section, a part of the bottom portion of the head section connected to the base section of the engaging section tends to have a large wall thickness. If the slide core has the protrusion according to the above mode (2), a mass of a material which provides the thick-walled part of the bottom portion is depressed toward the base section of the engaging section by the protrusion of the slide core in the die-casting step, to thereby sufficiently reduce the thickness of the thick-walled part of the bottom portion. The protrusion of the slide core is formed to extend in parallel to the centerline of the slide core, so that the slide core can be easily retracted out of the formed body member while avoiding an interference of the protrusion of the slide core with the body member.

(3) A method according to the above mode (1) or (2), the slide core is provided with a squeezing member which is slidably movable in a direction parallel to the centerline of the head section, the step of die-casting the body member comprising forcing an end portion of the squeezing member into a molten metal which fills the mold cavity to give the body member, whereby blow holes present in the molten metal are removed.

The engaging section of the body member tends to have a large wall thickness as compared with that of the head section, and accordingly suffers from blow holes formed therein. In the present arrangement, the squeezing member is forced into the molten metal, whereby the blow holes can be effectively eliminated owing to the pressure applied by the squeezing member.

(4) A method according to the above mode (3), wherein the squeezing member is formed concentrically with the slide core so as to press a central portion of the inner bottom surface of the head section.

With the squeezing member being forced into the central portion of the inner bottom surface of the head section, there is left a hollow residual wall at the central portion. The residual wall can be easily removed by a method according to the following mode (5). Although the residual wall need not be removed since the residual wall is formed within the head section of the body member, it is preferable to remove the residual wall in order to reduce the weight of the piston.

(5) A method according to any one of the above modes (1)–(4), further comprising a step of: subjecting the body member formed by die-casting to a machining operation to cut off a hollow residual wall which is formed at the central portion of the inner bottom surface of the head section, as a result of an operation of the squeezing member, the machining operation comprising rotating a rotary cutting tool and the body member relative to each other about the centerline of the head section.

(6) A method according to any one of the above modes (1)–(5), wherein the step of die-casting the body member comprises die-casting two body members each having the engaging section and the head section, the two body members being connected to each other at their ends on the side of the engaging sections, such that the head sections of the two body members are concentric with each other, and such that each of the head sections of the two body members is open at one of its opposite ends which is remote from the engaging sections which are connected together.

The present arrangement is effective to reduce a cost of die-casting the body member for the piston while facilitating the machining operation to be effected thereon, resulting in a reduced cost of manufacture of the piston.

(7) A method according to any one of the above modes (1)–(6), wherein the step of die-casting the body member is effected according to a pore-free die-casting method.

The pore-free die-casting method prevents a gas from being trapped in a die-cast article, by introducing a molten metal such as a molten aluminum alloy into a mold cavity of a casting mold, with the mold cavity being filled with a reactive gas such as an oxygen, so that the mold cavity is placed in a highly vacuum state owing to a reaction between the molten metal and the reactive gas. The die-cast article formed by the pore-free die-casting method described above exhibits a high degree of mechanical strength with a relatively small wall thickness.

(8) A method according to the above mode (7), wherein the hollow cylindrical head section has a wall thickness of not larger than 1.8 mm.

The pore-free die-casting method described above is advantageous for producing a thin-walled die-cast article. By suitably determining the die-casting condition in producing the body member for the piston, the wall thickness of the head section of the body member can be reduced to not greater than 1.8 mm, 1.5 mm, or 1.2 mm.

(9) A method of producing a piston for a swash plate type compressor having a body member produced by the method according to the above mode (7) or (8), the hollow cylindrical head section of the body member is closed at its one end by the closing member to provide the head portion of the piston, without effecting a machining operation on an inner circumferential surface of the head section.

Since the pore-free die-casting method permits production of a thin-walled die-cast article having high degrees of mechanical strength and dimensional accuracy, the body member formed by the pore-free die-casting method need not be subjected to a machining operation which would be otherwise effected on the inner circumferential surface of the hollow cylindrical head section to reduce its wall thickness. The elimination of the machining operation permits an economical manufacture of the piston. The present arrangement wherein the closing member closes the open end of the hollow cylindrical head section on the side remote from the engaging section assures a higher degree of durability of the piston during use than an arrangement wherein the closing member closes the open end of the hollow cylindrical head section on the side of the engaging section.

While the method according to the present invention is suitable for producing a single-headed piston used in a swash plate type compressor of variable capacity type, the present method is equally applicable for producing a piston used in a swash plate type compressor of fixed capacity type, and a double-headed piston.

BRIEF DESCRIPTION OF THE DRAWINGS

The above and optional objects, features, advantages and technical and industrial significance of the present invention will be better understood and appreciated by reading the following detailed description of presently preferred embodiments of the invention, when considered in connection with the accompanying drawings, in which.

DETAILED DESCRIPTION OF THE PREFERRED EMBODIMENTS

Referring to the accompanying drawings, there will be described presently preferred embodiments of the present invention as applied to the body member used for manufacturing a single-headed piston for a swash plate type compressor used for an air conditioning system of an automotive vehicle.

Figure 1:
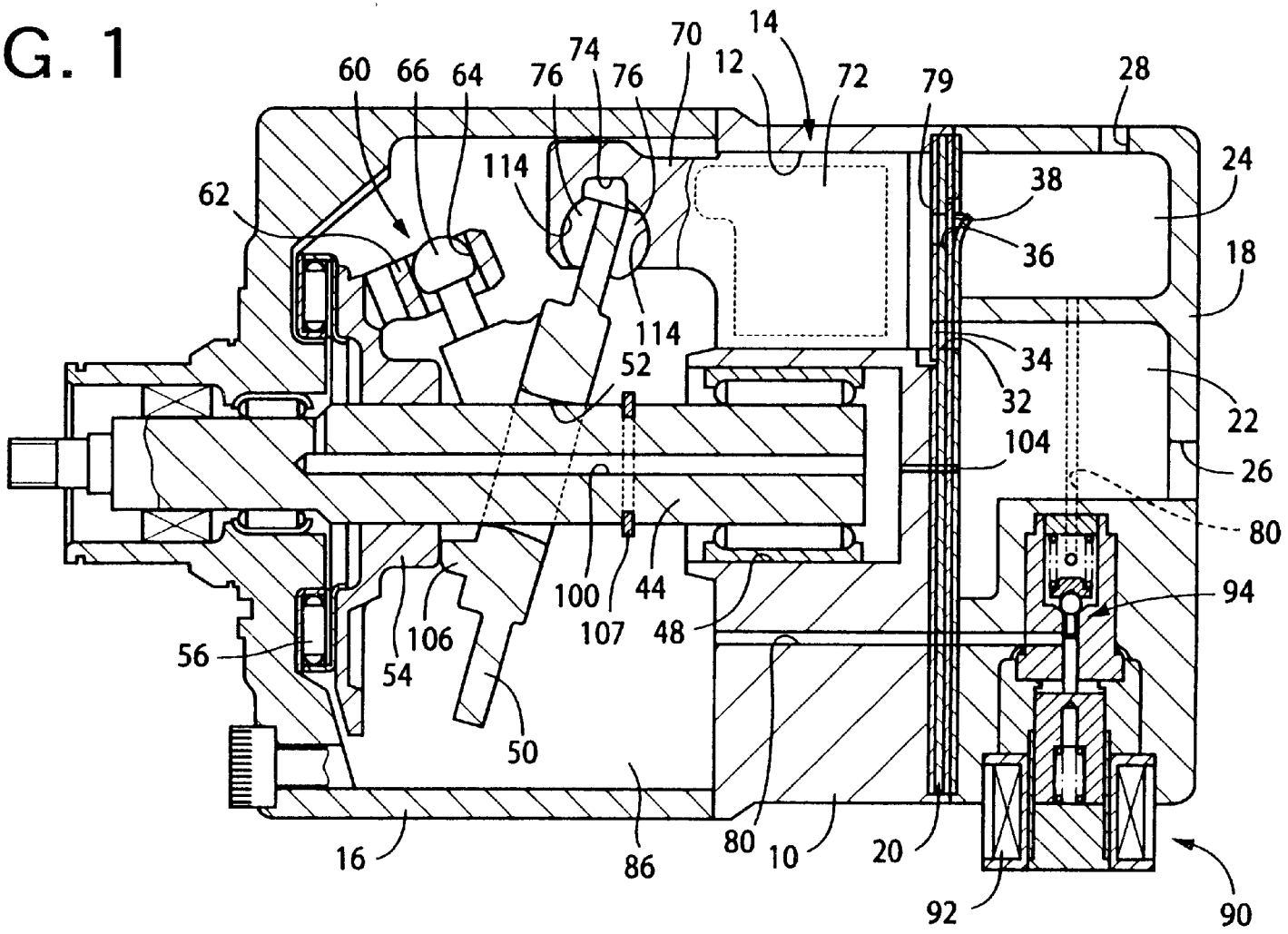
FIG. 1 is a front elevational view in cross section of a swash plate type compressor equipped with a piston constructed according to one embodiment of the present invention.

Referring first to FIG. 1, there is shown a compressor of swash plate type incorporating a plurality of single-headed pistons (hereinafter referred to simply as "pistons") each constructed according to one embodiment of the present invention.

In FIG. 1, reference numeral 10 denotes a cylinder block having a plurality of cylinder bores 12 formed so as to extend in its axial direction such that the cylinder bores 12 are arranged along a circle whose center lies on a centerline of the cylinder block 10. The piston generally indicated at 14 is reciprocably received in each of the cylinder bores 12. To one of the axially opposite end faces of the cylinder block 10, (the left end face as seen in FIG. 1, which will be referred to as "front end face"), there is attached a front housing 16. To the other end face (the right end face as seen in FIG. 1, which will be referred to as "rear end face"), there is attached a rear housing 18 through a valve plate 20. The front housing 16, rear housing 18 and cylinder block 10 cooperate to constitute a housing assembly of the swash plate type compressor. The rear housing 18 and the valve plate 20 cooperate to define a suction chamber 22 and a discharge chamber 24, which are connected to a refrigerating circuit (not shown) through an inlet 26 and an outlet 28, respectively. The valve plate 20 has suction ports 32, suction valves 34, discharge ports 36 and discharge valves 38.

A rotary drive shaft 44 is disposed in the cylinder block 10 and the front housing 16 such that the axis of rotation of the drive shaft 44 is aligned with the centerline of the cylinder block 10. The drive shaft 44 is supported at its opposite end portions by the front housing 16 and the cylinder block 10, respectively, via respective bearings. The cylinder block 10 has a central bearing hole 48 formed in a central portion thereof, and the bearing is disposed in this central bearing hole 48, for supporting the drive shaft 44 at its rear end portion. The front end portion of the drive shaft 44 is connected, through a clutch mechanism such as an electromagnetic clutch, to an external drive source (not shown) in the form of an engine of an automotive vehicle. In operation of the compressor, the drive shaft 44 is connected through the clutch mechanism to the vehicle engine in operation so that the drive shaft 44 is rotated about its axis. The rotary drive shaft 44 carries a swash plate 50 such that the swash plate 50 is axially movable and tiltable relative to the drive shaft 44. The swash plate 50 has a central hole 52 through which the drive shaft 44 extends. The diameter of the central hole 52 of the swash plate 50 gradually increases in the axially opposite directions from its axially intermediate portion towards the axially opposite ends. To the drive shaft 44, there is fixed a rotary member 54 as a torque transmitting member, which is held in engagement with the front housing 16 through a thrust bearing 56. The swash plate 50 is rotated with the drive shaft 44 by a hinge mechanism 60 during rotation of the drive shaft 44. The hinge mechanism 60 guides the swash plate 50 for its axial and tilting motions. The hinge mechanism 60 includes a pair of support arms 62 fixed to the rotary member 54, guide pins 66 which are formed on the swash plate 50 and which slidably engage guide holes 64 formed in the support arms 62, the central hole 52 of the swash plate 50, and the outer circumferential surface of the drive shaft 44. It is noted that the swash plate 50 constitutes a drive member for driving the pistons 14, while the rotary drive shaft 44, the drive source in the form of the vehicle engine and the torque transmitting device in the form of the hinge mechanism 60 cooperate with each other to constitute a major portion of a drive device for driving the drive member.

The piston 14 indicated above includes an engaging portion 70 engaging the swash plate 50, and a head portion 72 formed integrally with the engaging portion 70 and fitted in the corresponding cylinder bore 12. The engaging portion 70 has a groove 74 formed therein, and the swash plate 50 is held in engagement with the groove 74 through a pair of hemispherical shoes 76. The hemispherical shoes 76 are held in the groove 74 such that the shoes 76 slidably engage the engaging portion 70 at their hemispherical surfaces and such that the shoes 76 slidably engage the radially outer portions of the opposite surfaces of the swash plate 50 at their flat surfaces. The configuration of the piston 14 will be described in detail.

A rotary motion of the swash plate 50 is converted into a reciprocating linear motion of the piston 14 through the shoes 76. A refrigerant gas in the suction chamber 22 is sucked into the pressurizing chamber 79 through the suction port 32 and the suction valve 34, when the piston 14 is moved from its upper dead point to its lower dead point, that is, when the piston 14 is in the suction stroke. The refrigerant gas in the pressurizing chamber 79 is pressurized by the piston 14 when the piston 14 is moved from its lower dead point to its upper dead point, that is, when the piston 14 is in the compression stroke. The pressurized refrigerant gas is discharged into the discharge chamber 24 through the discharge port 36 and the discharge valve 38. A reaction force acts on the piston 14 in the axial direction as a result of compression of the refrigerant gas in the pressurizing chamber 79. This compression reaction force is received by the front housing 16 through the piston 14, swash plate 50, rotary member 54 and thrust bearing 56.

Figure 2:
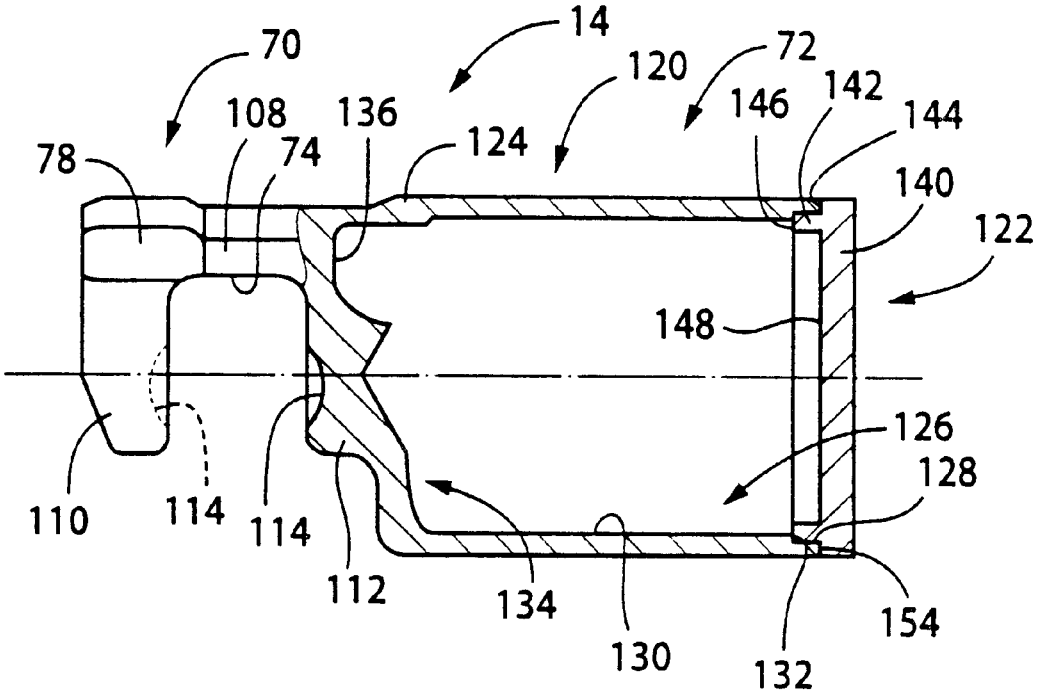
FIG. 2 is a front elevational view partly in cross section of the piston shown in FIG. 1.

As shown in FIG. 2, the engaging portion 70 of the piston 14 has an integrally formed rotation preventive part 78, which is arranged to contact the inner circumferential surface of the front housing 16, for thereby preventing a rotary motion of the piston 14 about its centerline.

The cylinder block 10 has a supply passage 80 formed therethrough for communication between the discharge chamber 24 and a crank chamber 86 which is defined between the front housing 16 and the cylinder block 10. The supply passage 80 is connected to a solenoid-operated control valve 90 provided to control the pressure in the crank chamber 86. The solenoid-operated control valve 90 includes a solenoid coil 92, and a shut-off valve 94 which is selectively closed and opened by energization and de-energization of the solenoid coil 92. Namely, the shut-off valve 94 is placed in its closed state when the solenoid coil 92 is energized, and is placed in its open state when the coil 92 is de-energized.

The rotary drive shaft 44 has a bleeding passage 100 formed therethrough. The bleeding passage 100 is open at one of its opposite ends to the central bearing hole 48, and is open to the crank chamber 86 at the other end. The central bearing hole 48 communicates at its bottom with the suction chamber 22 through a communication port 104.

The present swash plate type compressor is a variable capacity type. By controlling the pressure in the crank chamber 86 by utilizing a difference between the pressure in the discharge chamber 24 as a high-pressure source and the pressure in the suction chamber 22 as a low pressure source, a difference between the pressure in the crank chamber 86 which acts on the front side of the piston 14 and the pressure in the pressurizing chamber 79 is regulated to change the angle of inclination of the swash plate 50 with respect to a plane perpendicular to the axis of rotation of the drive shaft 44, for thereby changing the reciprocating stroke (suction and compression strokes) of the piston 14, whereby the discharge capacity of the compressor can be adjusted.

As described above, the pressure in the crank chamber 86 is controlled by controlling the solenoid-operated control valve 90 to selectively connect and disconnect the crank chamber 86 to and from the discharge chamber 24. Described more specifically, when the solenoid coil 92 of the solenoid-operated control valve 90 is energized, the supply passage 80 is closed, so that the pressurized refrigerant gas in the discharge chamber 24 is not delivered into the crank chamber 86. In this condition, the refrigerant gas in the crank chamber 86 flows into the suction chamber 22 through the bleeding passage 100 and the communication port 104, so that the pressure in the crank chamber 86 is lowered, to thereby increase the angle of inclination of the swash plate 50. The reciprocating stroke of the piston 14 which is reciprocated by rotation of the swash plate 50 increases with an increase of the angle of inclination of the swash plate 50, so as to increase an amount of change of the volume of the pressurizing chamber 79, whereby the discharge capacity of the compressor is increased. When the solenoid coil 92 is de-energized, the supply passage 80 is opened, permitting the pressurized refrigerant gas to be delivered from the discharge chamber 24 into the crank chamber 86, resulting in an increase in the pressure in the crank chamber 86, and the angle of inclination of the swash plate 50 is reduced, so that the discharge capacity of the compressor is accordingly reduced.

The maximum angle of inclination of the swash plate 50 is limited by abutting contact of a stop 106 formed on the swash plate 50, with the rotary member 54, while the minimum angle of inclination of the swash plate 50 is limited by abutting contact of the swash plate 50 with a stop 107 in the form of a ring fixedly fitted on the drive shaft 44. The solenoid coil 92 of the solenoid-operated control valve 90 is controlled by a control device not shown depending upon a load acting on the air conditioning system including the present compressor. The control device is principally constituted by a computer. In the present embodiment, the supply passage 80, the crank chamber 86, the solenoid-operated control valve 90, the bleeding passage 100, the communication port 104, and the control device for the control valve 90 cooperate to constitute a major portion of a crank chamber pressure control device for controlling the pressure in the crank chamber 86, or a swash plate angle adjusting device for controlling the angle of inclination of the swash plate 50 (a discharge capacity adjusting device for adjusting the discharge capacity of the compressor).

The cylinder block 10 and each piston 14 are formed of an aluminum alloy. The piston 14 is coated at its outer circumferential surface with a fluoro resin film which prevents a direct contact of the aluminum alloy of the piston 14 with the aluminum alloy of the cylinder block 10 so as to prevent seizure therebetween, and makes it possible to minimize the amount of clearance between the piston 14 and the cylinder bore 12. The cylinder block 10 and the piston 14 may also be formed of an aluminum silicon alloy. Other materials may be used for the cylinder block 10, the piston 14, and the coating film.

There will next be described the configuration of the piston 14.

The end portion of the engaging portion 70 of the piston 14, which is remote from the head portion 72, has a U-shape in cross section, as shown in FIG. 2. Described in detail, the engaging portion 70 has a base section 108 which defines the bottom of the U-shape and a pair of substantially parallel arm sections 110, 112 which extend from the base section 108 in a direction perpendicular to the axis of the piston 14. The base section 108 corresponds to a circumferential portion of the piston 14 which corresponds to a radially outer portion of the cylinder block 10 when the piston 14 is fitted in the appropriate cylinder bore 12. The two opposed lateral walls of the U-shape of the end portion of the engaging portion 70 have respective recesses 114 which are opposed to each other. Each of these recesses 114 is defined by a part-spherical inner surface of the lateral wall. The pair of shoes 76 indicated above are held in contact with the opposite surfaces of the swash plate 50 at its radially outer portion and are received in the respective part-spherical recesses 114. Thus, the engaging portion 70 slidably engages the swash plate 50 through the shoes 76.

The head portion 72 of the piston 14 is formed integrally with the engaging portion 70 on the side of its arm section 112, and includes a cylindrical body portion 120 which is open on one of its opposite ends on the side remote from the arm section 112 of the engaging portion 70, and a closure member 122 fixed to the body portion 120 for closing the open end of the body portion 120. The engaging portion 70 and the head portion 72 are formed integrally with each other. Namely, the arm section 112 of the engaging portion 70 and a bottom portion 124 of the body portion 120 of the head portion 72 are integral with each other. The base section 108 of the engaging portion 70 extends in a direction parallel to the centerline of the body portion 120 from a radially outer portion of the bottom portion 124 of the body portion 120, which radially outer portion is spaced a suitable distance from the centerline. The body portion 120 has an inner circumferential surface 126 which is divided into two portions, i.e., a large-diameter portion 128 on the side of its open end and a small-diameter portion 130 remote from the open end, which two portions cooperate with each other to define a shoulder 132 therebetween.

Figure 3:
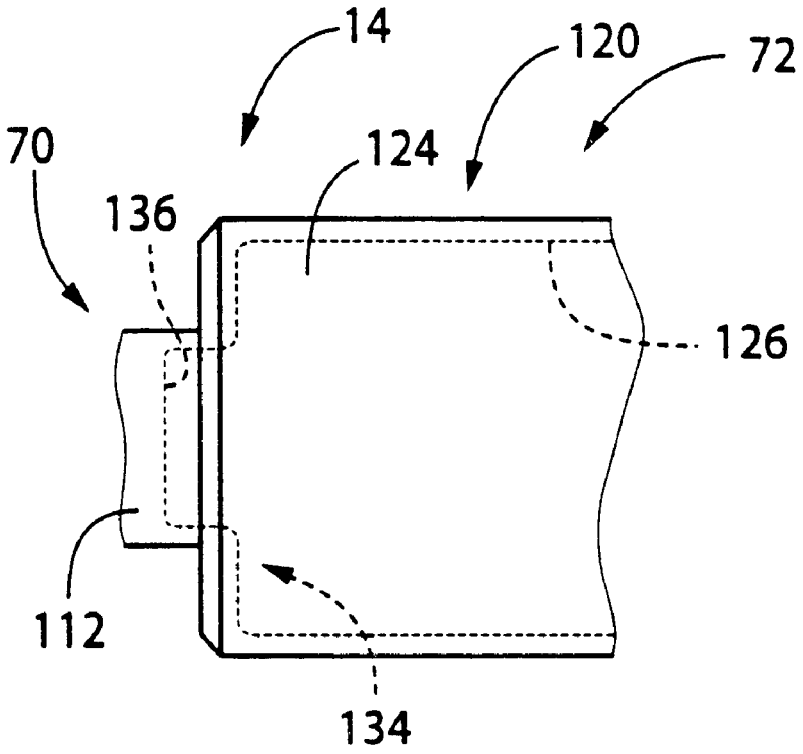
FIG. 3 is a fragmentary plan view of the piston of FIG. 2.

The cylindrical body portion 120 of the head portion 72 of the piston 14 has an inner bottom surface 134 remote from its open end. The inner bottom surface 134 has a three-dimensional configuration which is nonaxisymmetric with respect to the centerline of the body portion 120. Described in detail, the inner bottom surface 134 is formed with a recess 136 at a radially outer portion which is offset from the centerline of the body portion 120, and at a circumferential portion which corresponds to the base portion 108 of the engaging portion 70, as shown in FIGS. 2 and 3. In other words, the above-indicated circumferential portion of the inner bottom surface 134 is recessed or depressed toward the arm section 112 in a direction parallel to the centerline of the body portion 120. As shown in FIG. 3, the dimensions of the recess 136, as measured in the directions parallel and perpendicular to the centerline of the body portion 120 (in the directions perpendicular and parallel to the direction of extension of the arm sections 110, 112 from the base section 108), are smaller by suitable amounts than those of the arm section 112. In the presence of the recess 136, the arm section 112 has a reduced weight.

The closure member 122 is a generally disc-shaped member which consists of a circular plate portion 140, and an annular fitting protrusion 142 which protrudes from one of the opposite end faces (the inner end face) of the plate portion 140 and which has a diameter smaller than that of the plate portion 140. A shoulder 144 is formed between the circular plate portion 140 and the annular fitting protrusion 142. The closure member 122 has a circular recess 148 which defines the annular fitting protrusion 142 and is open in an end face 146 of the fitting protrusion 142, so that the weight of the closure member 122 is reduced. The closure member 122 is fitted into the inner circumferential surface 126 of the body portion 120 such that the shoulder 144 of the closure member 122 is held in abutting contact with an end face 154 of the body portion 120, and such that end face 146 of the annular fitting protrusion 142 of the closure member 122 is held in abutting contact with the shoulder 132 formed between the large-diameter portion 128 and the small-diameter portion 130 of the inner circumferential surface 126 of the body portion 120. In this state, the outer circumferential surface of the fitting protrusion 142 of the closure member 122 engages the large-diameter portion 128 of the inner circumferential surface 126 of the body portion 120. The closure member 122 is fixed to the body portion 120 by welding. The compression reaction force which acts on the end face of the piston 14, which end face partially defines the pressurizing chamber 79, as a result of compression of the refrigerant gas in the pressurizing chamber 79 during the compression stroke of the piston 14, is received by the abutting contact of the shoulder 144 of the closure member 122 with the end face 154 of the body member 120 and the abutting contact of the end face 146 of the fitting protrusion 142 of the closure member 122 with the shoulder 132 of the body portion 120, as well as contacting circumferential surfaces of the body portion 120 and the closure member 122, which surfaces are bonded by welding. In FIG. 2, the cylindrical wall thickness of the body portion 120 is exaggerated for easier understanding.

Figure 4:
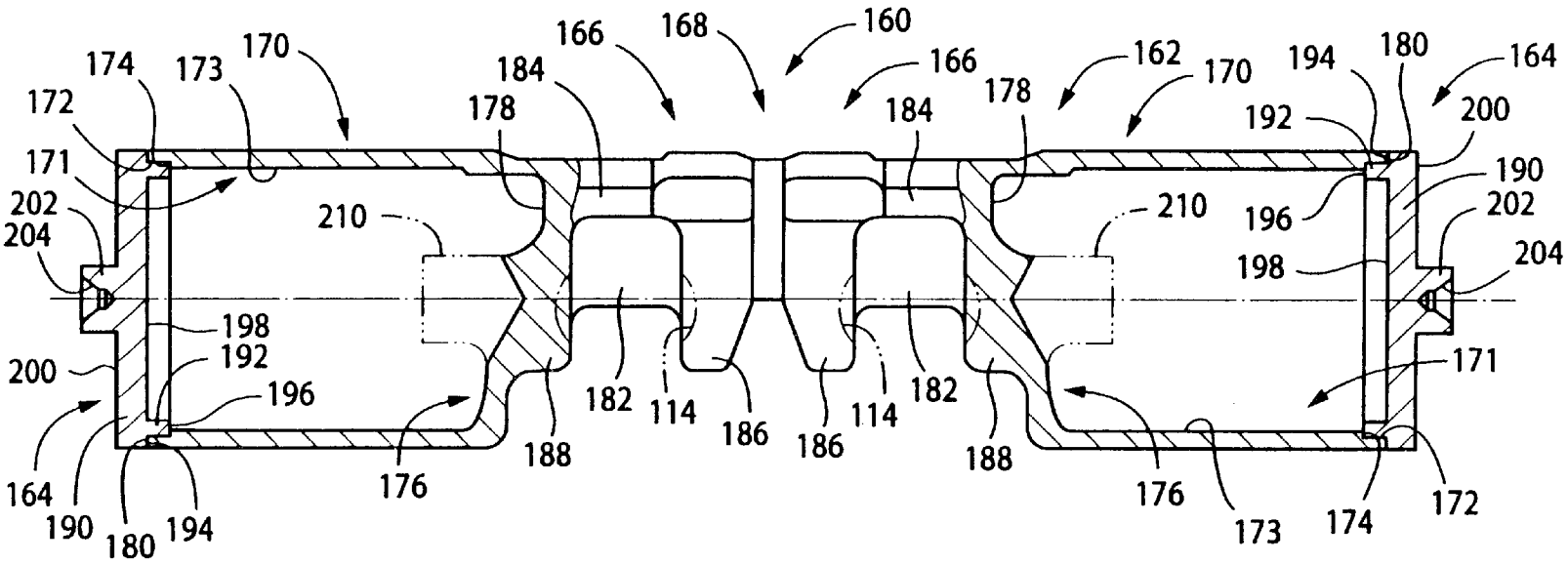
FIG. 4 is a front elevational view partly in cross section showing a body member used for manufacturing the piston of FIG. 2, after closing members are fixed to the body member.

Two pieces of the piston 14 constructed as described above are produced from a single blank 160 shown in FIG. 4. The blank 160 used for producing the two pistons 14 has a body member 162 and two closing members 164. The body member 162 consists of a twin engaging section 168 and two cylindrical hollow head sections 170 formed integrally with the twin engaging section 168 such that the two hollow head sections 170 extend from the opposite ends of the twin engaging section 168 in the opposite directions. The twin engaging section 168 consists of two engaging sections 166 which are formed in series and integrally with each other and which provide respective two engaging portions 70 of the two single-headed pistons 14. Each of the two hollow head sections 170 is closed at one of its opposite ends which is on the side of the twin engaging section 168, and is open at the other end. The two head sections 170 are concentric with each other. It may be considered that the body member 162 consists of two body members each of which includes a single engaging section 166 and a single head section 170 which are connected to each other at their ends on the side of the engaging sections 166 such that the two head sections are concentric with each other, and such that each head section is open at one of its opposite ends remote from the engaging section.

Each head section 170 of the body member 162 has an inner circumferential surface 171 which is divided into two portions, i.e., a large-diameter portion 172 on the side of its open end and a small-diameter portion 173 remote from the open end, which two portions cooperate with each other to define a shoulder 174 therebetween. Each head section 170 has an inner bottom surface 176 remote from its open end. The inner bottom surface 176 has a three-dimensional configuration which is nonaxisymmetric with respect to the centerline of the head section 170. Described in detail, the inner bottom surface 176 is formed with a recess 178 at a radially outer portion which is offset from the centerline of the head section 170, and at a circumferential portion which corresponds to a base portion 184 of the engaging section 166 which will be described. In other words, the above-indicated circumferential portion of the inner bottom surface 176 is recessed or depressed toward an arm section 188 of the engaging section 166 which will be described. The inner circumferential surface 171 and the inner bottom surface 176 which has the recess 178 respectively provide the inner circumferential surface 126 and the inner bottom surface 134 of the piston 14. The end face 180 of the head section 170 of the body member 162 provides the end face 154 of the body portion 120 of the piston 14. The head section 170 has a cylindrical wall thickness of 1.5 mm except its axial end portion corresponding to the large-diameter portion 172. For easier understanding, the cylindrical wall thickness of the head section 170 is exaggerated in FIGS. 4 and 5.

Each of the two engaging sections 166 includes the base section 184 functioning as the base portion 108 of the piston 14 and a pair of opposed parallel arm sections 186, 188 functioning as the arm sections 110, 112 of the piston 14. Reference numeral 182 denotes two bridge portions, each of which connects the inner surfaces of the arm sections 186, 188, in order to reinforce the engaging section 166 for increasing the rigidity of the body member 162, for improved accuracy of a machining operation on the blank 160, which is effected while the blank 160 is held at its opposite ends by chucks as described later. Each bridge portion 182 also functions as a reinforcing portion by which the body member 162 is protected from being deformed due to heat. In the present embodiment, the body member 162 is formed by die-casting of a metallic material in the form of an aluminum alloy. This formation of the body member 162 by die-casting is a step of preparing the body member 162 which will be described in detail.

The two closing members 164 are identical in construction with each other as shown in FIG. 4. Like the closure member 122, each of the closing members 164 includes a circular plate portion 190 and an annular fitting protrusion 192 which protrudes from one of the opposite end faces (the inner end face) of the circular plate portion 190. A shoulder 194 is formed between the circular plate portion 190 and the annular fitting protrusion 192. The closing member 164 has a circular recess 198 which defines the annular fitting protrusion 192 and is open in an end face 196 of the fitting protrusion 192. The shoulder 194 and the recess 198 of the closing member 164 respectively function as the shoulder 144 and the recess 148 of the closure member 122. The circular plate portion 190 of each closing member 164 has a holding portion 202 formed at a central portion of its outer end face 200 which is opposite to the inner end face on which the annular fitting protrusion 192 is formed. The holding portion 202 has a circular shape in cross section, and has a center hole 204. In the present embodiment, the closing member 164 is formed by die-casting of a metallic material in the form of an aluminum alloy. This formation of the closing members 164 by die-casting is a step of preparing the closing members 164. The circular plate portion 190 and the fitting protrusion 192 of the closing member 164 have the same dimensional relationship as the circular plate portion 140 and the fitting protrusion 142 of the closure member 122, and a detailed explanation of which is dispensed with.

Figure 5:
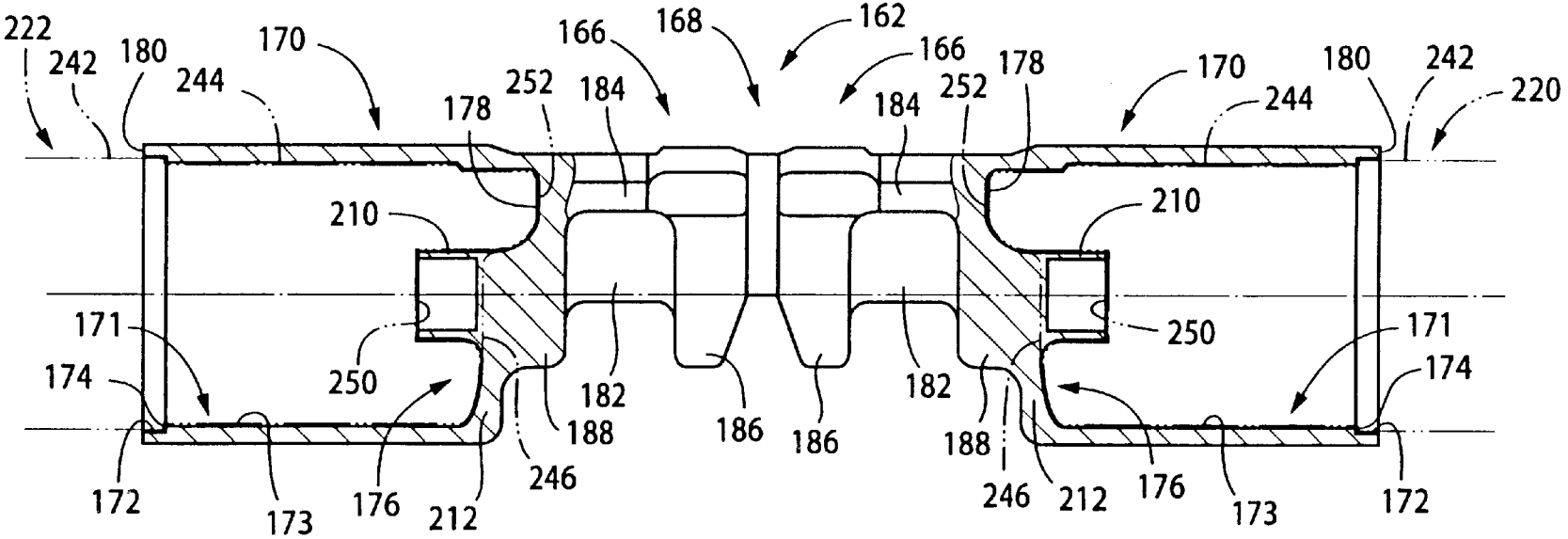
FIG. 5 is a front elevational view partly in cross section showing the body member of FIG. 4.

In the present embodiment, the body member 162 is formed by die-casting according to a pore-free method. This pore-free die-casting will be explained in greater detail. FIG. 5 shows the body member 162 which is die-cast according to the pore-free method. In the head section 170 of the die-cast body member 162, there remains a hollow cylindrical residual wall 210 at a radially central portion of its inner bottom surface 176. This residual wall 210 protrudes from the inner bottom surface 176 toward the open end of the head section 170, in a direction parallel to the centerline of the head section 170. The residual wall 210 is formed as a result of a squeezing operation in which a squeezing member which is pressed onto a central part of the bottom portion 212 of the head section 170.

There will be described a process of manufacturing the body member 162 by the pore-free die-casting while using a die-casting device schematically shown in FIG. 6.

The die-casting device used in the present invention includes a pair of mold halves 216, 218 which are carried by a main body of the device (not shown), and a pair of slide cores 220, 222 (indicated by a two-dot chain line in FIG. 5) which are disposed in the two mold halves 216, 218 such that the slide cores 220, 222 are slidably movable relative to the mold halves 216, 218. The two mold halves 216, 218 have respective molding surfaces 234, 236 which cooperate with the outer circumferential surfaces of the slide cores 220, 222, to define therebetween a mold cavity 224 whose profile follows that of the body member 162. Into the mold cavity 224, a molten aluminum alloy is introduced for molding the body member 162. The mold half 216 is stationary while the mold half 218 is movable relative to the stationary mold half 216. Contact surfaces 226, 228 of the two mold halves 218, 216 define a parting plane 229 shown in FIG. 7, at which the two mold halves 216, 218 are butted together and are spaced apart from each other by a suitable moving device (not shown), such that the movable mold half 218 is moved toward and away from the stationary mold half 216.

Figure 7:
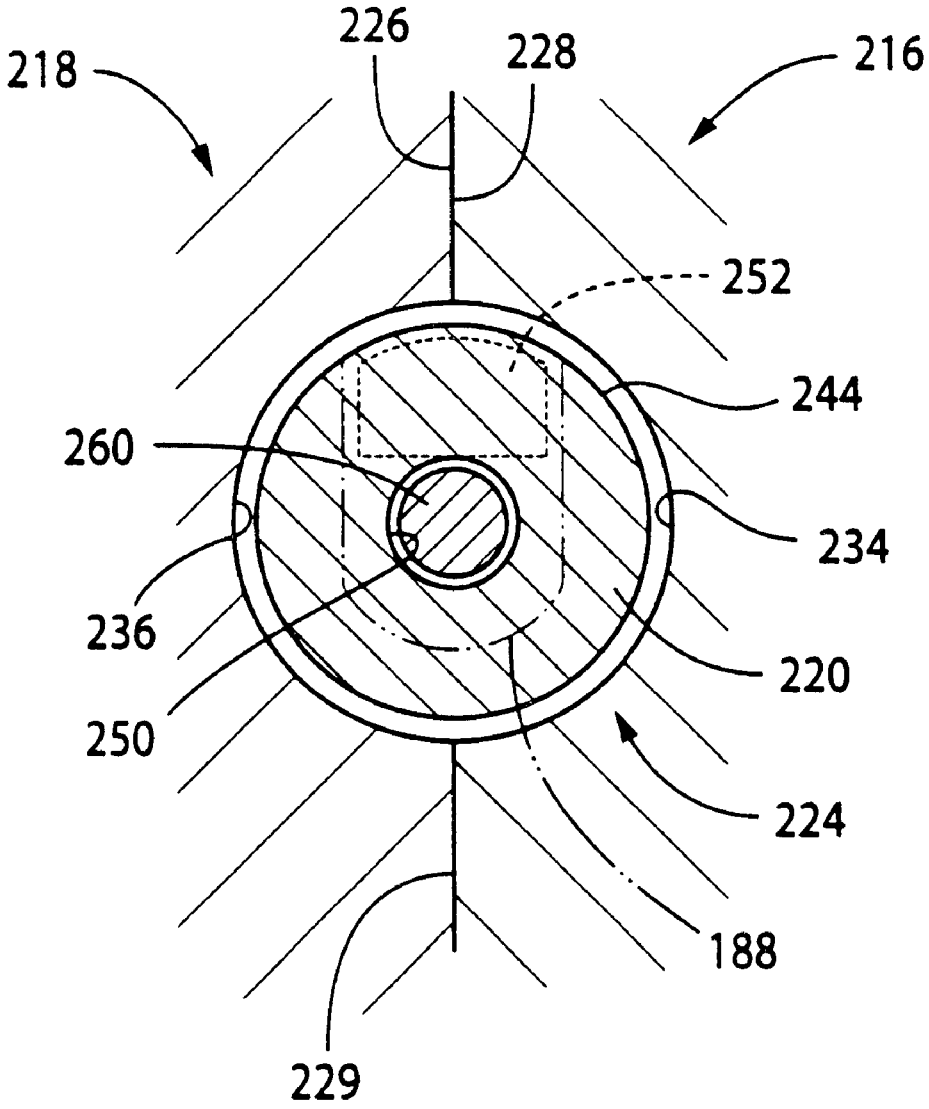
FIG. 7 is a side elevational view in cross section of a die-casting device used in the die-casting process of the method of the present invention.

As indicated in FIG. 7, the parting plane 229 includes the centerline of the blank 160 passing the centers of the generally cylindrical head sections 170 and is parallel to the direction of extension of the arm sections 186, 188 from the base sections 184 of the engaging sections 166. As described above, the two mold halves 216, 218 have the respective molding surfaces 234, 236 which cooperate with the outer circumferential surfaces 244 of the slide cores 220, 222, to define therebetween the mold cavity 224 whose profile follows that of the body member 162. The slide cores 220, 222 are disposed in the casting mold 215 consisting of the two mold halves 216, 218, such that the slide cores 220, 222 are advanced into and retracted out of the casting mold 215 by a suitable drive device not shown. The slide cores 220, 222 indicated in the two-dot chain line in FIG. 5 are slidably movable in a direction parallel to the centerline of the cylindrical head sections 170 and in a direction perpendicular to the parting direction described above. The drive device for driving the slide cores 220, 222 include hydraulically operated cylinders, for example. Each of the slide cores 220, 222 includes a front end portion to be inserted into the casting mold 215 and a cylindrical portion remote from the front end portion. Each slide core 220, 222 is movable between an advanced position in which the outer circumferential surface of each slide core 220, 222 cooperates with the molding surfaces 234, 236 of the two mold halves 216, 218 to define the molding cavity 224, and a retracted position in which the front end portion of each slide core 200, 202 is located outside the casting mold 215. The front end portion of each slide core 220, 222 has a nonaxisymmetric configuration with respect to its axis corresponding to the configuration of the inner bottom surface 176 of the head section 170. The outer circumferential surface of the cylindrical portion of each slide core 220, 222 which is opposite to the front end portion is divided into two sections, i.e., a large-diameter section 242 whose diameter corresponds to that of the large-diameter portion 172 of the head section 170 and a small-diameter section 244 whose diameter corresponds to that of the small-diameter portion 173 of the head section 170.

As indicated in FIGS. 5 and 7, each slide core 220, 222 has a recess 250 formed at a radially central portion of its front end face 246 and having a circular cross sectional shape. The slide core 220, 222 includes a protrusion 252 which protrudes from a circumferential portion of the front end face 246 corresponding to the base section 184 of the engaging section 166, in the direction parallel to the centerline of the head section 170. As shown in FIG. 7, the dimensions of the protrusion 252 of each slide core 220, 222, as measured in the directions parallel and perpendicular to the centerline of he head section 170, are smaller than those of the arm section 188 (indicated by the two-dot chain line in FIG. 7).

Figure 8A:
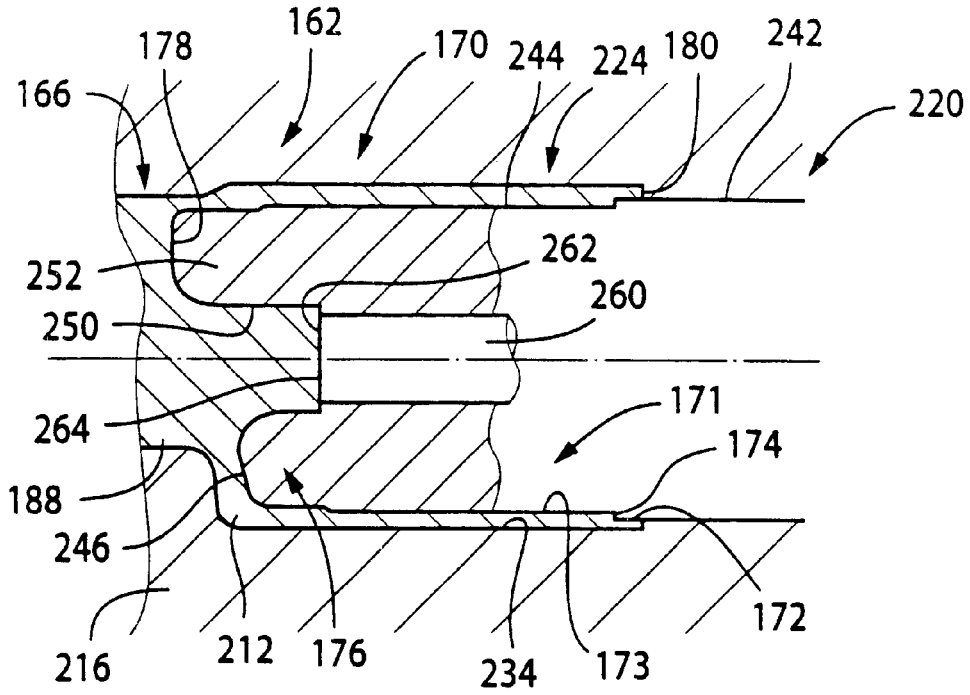
FIGS. 8A and 8B are views for explaining the process of die-casting the body member using the die-casting device of FIG. 7.
Figure 8B:
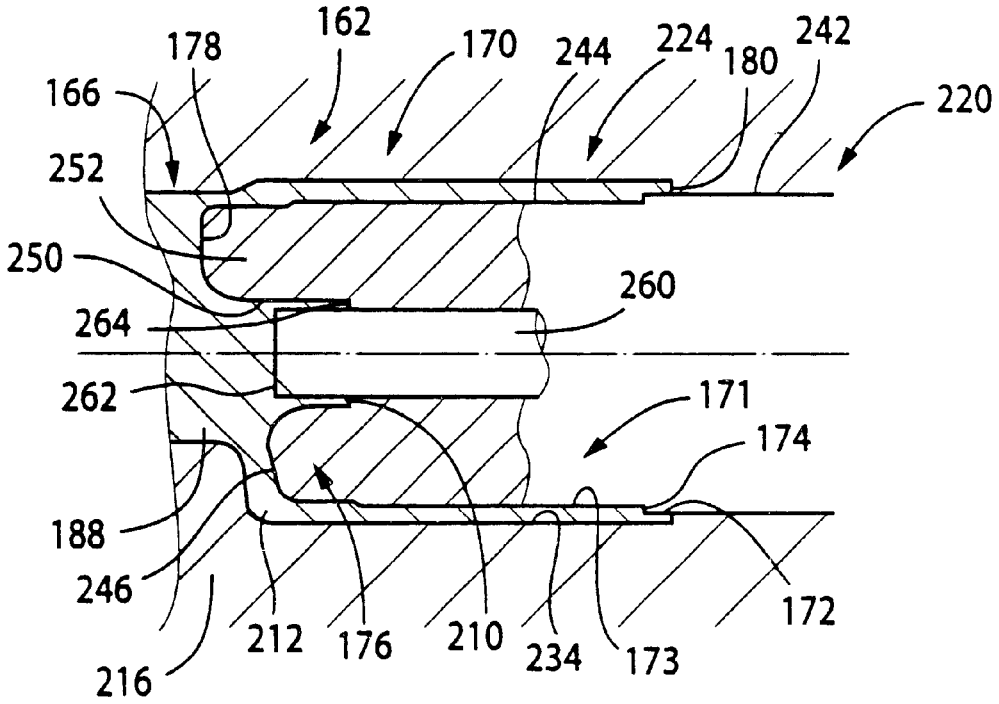

As shown in FIGS. 7 and 8, in each of the slide cores 220, 222, a squeezing member 260 is disposed in a concentric relation with each slide core 220, 222, and such that the squeezing members 260 of the two slide cores 220, 222 are axially movable relative to the slide cores 220, 222 by a suitable drive device not shown. Each squeezing member 260 has a circular cross sectional shape and a diameter smaller than that of the recess 250 formed in the front end face 246 of the slide core 220, 222. The squeezing member 260 is moved between a retracted position shown in FIG. 8A at which a front end face 262 of the squeezing member 260 is flush with a bottom 264 of the recess 250 of the slide core 220, 222, so that the front end face 262 partially defines the front end face 246 of the slide core 220, 222, and an advanced position shown in FIG. 8B at which the squeezing member 260 protrudes from the bottom 264 of the recess 250 of the slide core 220, 222.

Figures 6A, 6B, 6C:
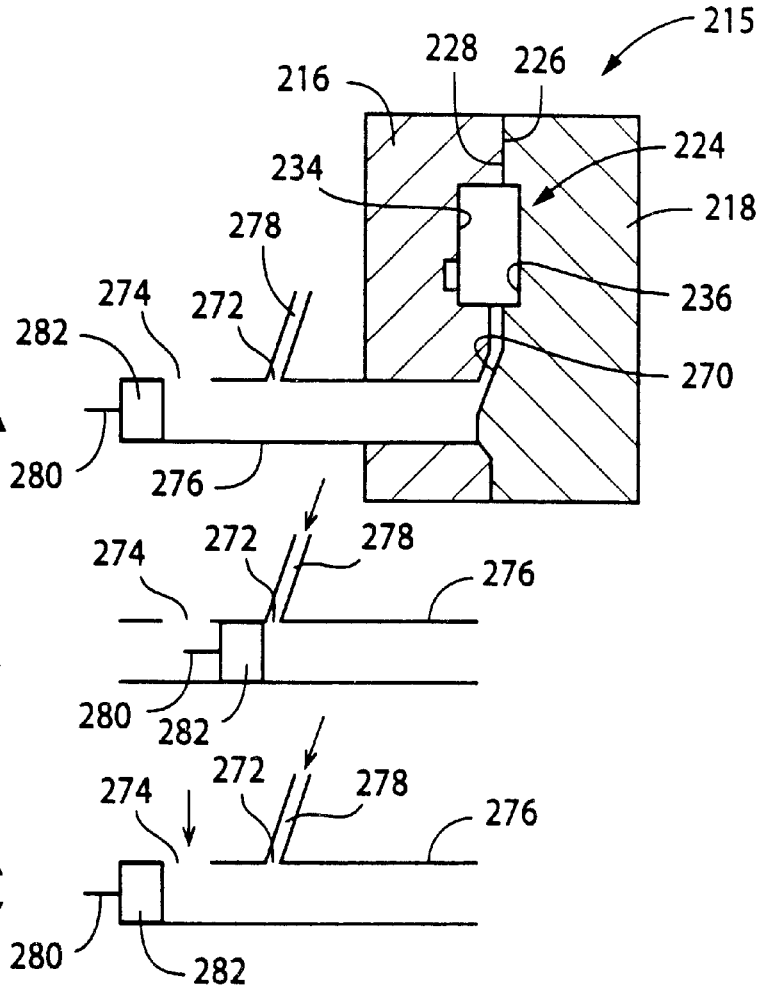
FIGS. 6A–6C are views for explaining a process of die-casting the body member according to the method of the present invention.

As shown in FIG. 6, the lower end of the mold cavity 224 is held in communication with a sleeve 276 via a runner 270. The sleeve 276 is provided with an $O_2$ inlet 272 and a molten metal inlet 274. The runner 270 has a gate (not shown) provided at one of its opposite open ends on the side of the mold cavity 224. This gate has a diameter smaller than the other portion of the runner 270. The runner 270 is held in communication with the sleeve 276 at the other open end. The $O_2$ inlet 272 is provided in the sleeve 276 such that it is located nearer to the casting mold 215 than the molten metal inlet 274. The $O_2$ inlet 272 is selectively connected and disconnected to and from an $O_2$ supply device or an $O_2$ supply source (not shown) via an $O_2$ supply passage 278. A molten metal (a molten aluminum alloy in the present embodiment) is injected through the molten metal inlet 274 into the sleeve 276. The sleeve 276 is a cylindrical member which extends through the mold half 216 so that one of its opposite end portions remote from the mold cavity 224 is located outside the casting mold 215. The $O_2$ inlet 272 and the molten metal inlet 274 are provided on the side of the above-indicated one end portion of the sleeve 276 located outside the casting mold 215. A plunger chip 282 formed at one end of a plunger 280 and having a diameter larger than that of the plunger 280 is slidably fitted in the sleeve 276. The plunger 280 is fixed to a piston of a plunger drive device in the form of a hydraulically operated cylinder not shown such that the plunger 280 is movable together with the piston. The above-indicated casting mold moving device, $O_2$ supply device, slide core drive device, and a die-casting device including the squeezing member drive device and the plunger drive device are controlled by a control device not shown. When the plunger chip 282 is in a retracted position shown in FIG. 6A, the molten metal inlet 274 is open for permitting the molten metal to flow therethrough into the sleeve 276.

When the plunger chip 282 is in the retracted position of in FIG. 6A, the two mold halves 216, 218 are butted together at the parting plane 229 so that the two mold halves 216, 218 are inhibited from moving relative to each other. In this state, each slide core 220, 222 is advanced into the two mold halves 216, 218 and each squeezing member 260 is placed in the retracted position of FIG. 8A. Subsequently, the plunger chip 282 is advanced past the molten metal inlet 274 and is stopped at an advanced position before it reaches the $O_2$ inlet 272, as shown in FIG. 6B, so that the mold cavity 224 formed in the casting mold 215 is inhibited from communicating with the atmosphere. In this state, an oxygen as a reactive gas is supplied through the $O_2$ inlet 272, so as to fill the mold cavity 224. Namely, the atmosphere in the mold cavity is substituted with the oxygen. Thereafter, the plunger chip 282 is placed in its retracted position with the oxygen being supplied through the $O_2$ inlet 272 into the sleeve 276, as shown in FIG. 6C. In this state, the molten metal is introduced into the sleeve 276 through the molten metal inlet 274. Subsequently, the plunger chip 282 is advanced at a high speed toward the casting mold 215, so that the level of the molten metal in the sleeve 276 is raised, whereby the molten metal is introduced into the runner 270, and then jetted into the mold cavity 224 through the narrow gate provided at the end of the runner 270. The oxygen in the mold cavity 224 reacts with the aluminum, and the mold cavity 224 is placed in a vacuum state in the absence of the oxygen, for thereby preventing the air, especially, nitrogen, from being trapped in the molten metal. Accordingly, the molten metal can easily flow through the mold cavity 224 which is defined by and between the molding surfaces 234, 236 of the two mold halves 216, 218 and the outer circumferential surfaces of the slide cores 220, 222 and which has a relatively small radial dimension corresponding to the small cylindrical wall thickness of the head section 170. The outer circumferential surface of each slide core 220, 222 gives the inner circumferential surface 171 of the head section 170 while the front end of the slide core 220, 222 gives the inner bottom surface 176 of the head section 170.

Since the molten metal is jetted through the narrow gate into the mold cavity 224, in the form of a fine mist, the molten metal is rapidly cooled after reaction with the oxygen, so that the solidified body member 162 has a chilled layer having a relatively large thickness. A chilled layer formed by the conventional die-casting method generally has a thickness of about 20 $\mu$m whereas the chilled layer formed by the present pore-free die-casting method has a thickness in the range of 40~50 $\mu$m. The chilled layer is characterized by a discontinuous change in the crystallization ratio of the primary crystal or $\alpha$-phase (proeutectic) and the eutectic silicon with respect to each other. Since the chilled layer has high values of hardness and strength, the presence of the chilled layer as the superficial portion of the body member 162 is effective to increase the strength of the head section 170 while reducing its wall thickness.

When the molten metal is in a semi-solid state a predetermined time after the molten metal was injected into the mold cavity 224, each squeezing member 260 is brought to its advanced position of FIG. 8B, so that the front end portion of the squeezing member 260 is forced into a mass of the molten metal which has flowed into the recess 250 of each slide core 220, 222. In other words, the squeezing member 260 pushes the central portion of the bottom portion 212 of the head section 170. When the squeezing member 260 is forced into the molten metal as described above, the pressure of the squeezing member 260 acts on the engaging section 166 through the bottom portion 212 of the head section 170. According to this arrangement, blow holes present in the molten metal mass corresponding to the engaging section 166 having a relatively large thickness can be effectively eliminated by the pressure applied from the squeezing member 260. The pair of squeezing members 260 are forced into the molten metal in the axially opposed directions, from the bottom portions 212 of the head sections 170 which are concentric with each other and which are formed at the axially opposite ends of the twin engaging section 168, toward the twin engaging section 168, for thereby effectively removing the blow holes present in the molten metal mass which gives the engaging sections 166. Each squeezing member 260 is retracted a predetermined time after it was placed in its advanced position, whereby the residual hollow cylindrical wall 210 described above is left at the central portion of the inner bottom surface 176 of the head section 170, as shown in FIG. 5.

Figure 9:
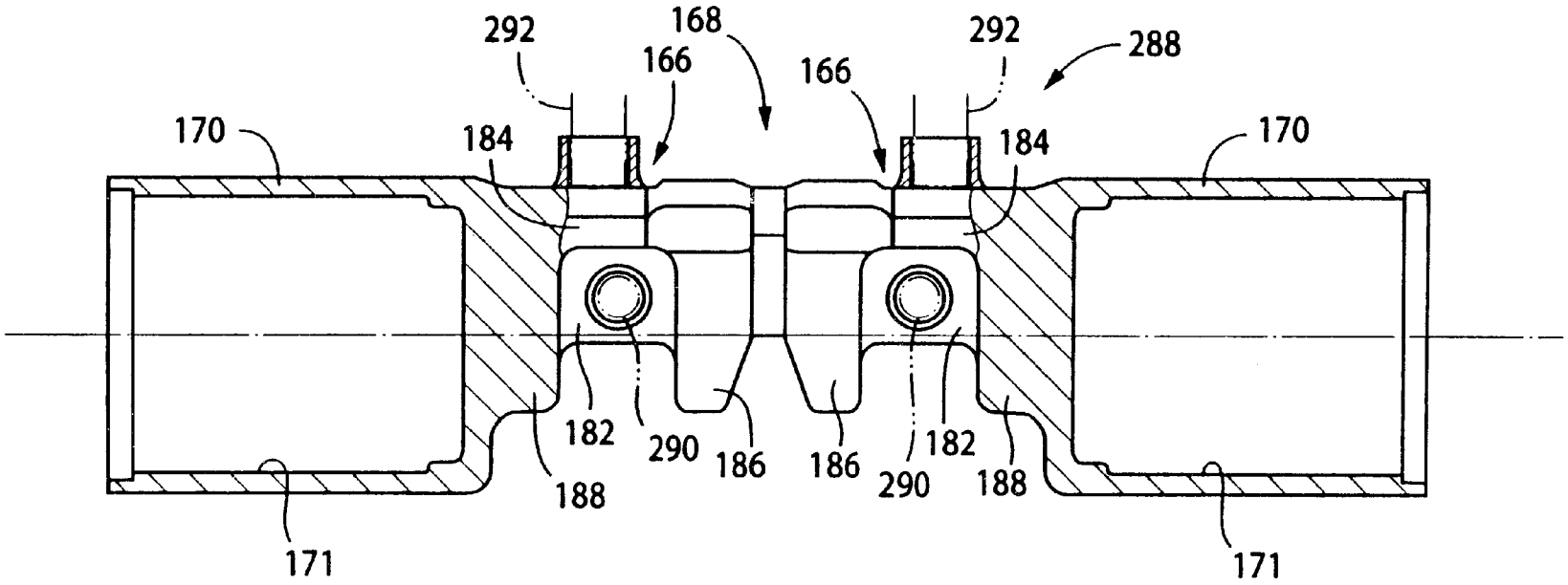
FIG. 9 PRIOR ART
FIG. 9 is a view showing squeezing members disposed in a conventional die-casting device.

FIG. 9 shows a conventional body member 288. In FIG. 9, the same reference numerals as used in FIG. 5 are used to identify the corresponding components, and a detailed explanation of which is dispensed with. In the conventional body member 288 of FIG. 9, the squeezing member 290 was pressed onto one of the opposite surfaces of the bridge section 182. Alternatively, the squeezing member 292 was pressed onto the outer surface of the base section 184 of the engaging section 166. On the surfaces of the body member 288 which had been pressed by the respective squeezing members 290, 292, hollow cylindrical walls are left. When the squeezing member 290 is pressed onto the surface of the bridge section 182, the pressure of the squeezing member 290 does not effectively act on the entirety of the engaging section 166 since the molten metal which has become semi-solid has an increased viscous resistance, making it difficult to eliminate the blow holes in the molten metal mass by the pressure applied from the squeezing member 290. When the squeezing member 292 is pressed onto the outer surface of the base section 184, a flow line may be formed on a portion of the base section 184 if the base section 184 is not uniformly pressed by the squeezing member 292, undesirably reducing the strength of the base section 184 at that portion. In this case, the base section 184 does not exhibit a sufficiently high degree of strength. Further, if the squeezing member 292 is pressed onto the outer surface of the base section 184 to an excessive extent, the outer surface of the base section 184 may be undesirably recessed.

In the present embodiment wherein each squeezing member 260 presses the bottom portion 212 of the head section 170 toward the engaging section 166, the blow holes can be effectively eliminated while avoiding the conventionally experienced problems described above.

The movable mold half 218 is separated away from the stationary mold half 216, and the slide cores 220, 222 are retracted out of the formed head sections 170 a predetermined time after each squeezing member 260 was moved to its retracted position. Then, the formed body member 162 is removed from the stationary mold half 216.

Figure 10:
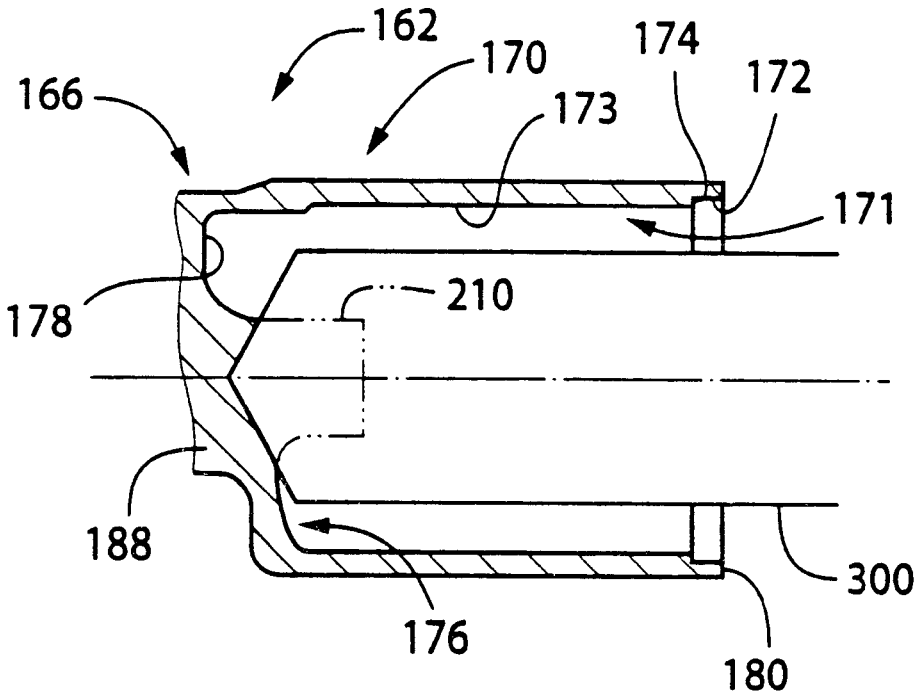
FIG. 10 is a view showing a step of cutting off a squeezed wall according to the method of the present invention.

Subsequently, the residual wall 210 formed as a result of a squeezing operation by each squeezing member 260 at the central portion of the inner bottom surface 176 of the head section 170 is removed by cutting. In the present embodiment, the body member 162 is held by a spindle of a lathe or turning machine such that the axis of the spindle is aligned with the centerline of the head section 170. With the body member 162 being rotated together with the spindle, a rotary cutting tool in the form of a drill 300 as shown in FIG. 10 is fed into the head section 170 for thereby cutting off the residual wall 210 left on the inner bottom surface 176 of the head section 170. This process of cutting off the residual wall by turning the body member 162 is an example of a machining step in the method of producing the body member 162. Alternatively, the residual wall 210 may be removed by rotating the rotary cutting tool. By cutting off the residual wall 210, the weight of the piston 14 can be reduced. However, it is not essential to remove the residual wall 210 since the residual wall 210 is formed within the hollow head section 170 which is closed by the closing member 164.

As shown in FIG. 4, each closing member 164 is fitted into the open end of the hollow head section 170 such that the annular fitting protrusion 192 of the closing member 164 engages the large-diameter portion 172 of the head section 170. The closing member 164 is inserted into the hollow head section 170 such that the shoulder 194 of the closing member 164 is held in abutting contact with the annular end face 180 of the head section 170, and such that the shoulder 174 of the head section 170 is held in abutting contact with the annular end face 196 of the fitting protrusion 192 of the closing member 164. In this state, the body member 162 and the closing members 164 are welded together by an electron beam welding. In the present embodiment, since the body member 162 and the each closing member 164 are both formed by die-casting and have a high dimensional accuracy, the closing members 164 are fitted in the body member 162 without prior mechanical working operations such as machining and grinding operations, resulting in a reduced cost of manufacture of the blank 160 for the single-headed pistons 14.

After the two closing members 164 are fixedly fitted in the respective open end portions of the body member 162 as described above, a machining operation is performed on the outer circumferential surfaces of the hollow head sections 170 which give the head portions 72 of the two pistons 14, respectively, and the exposed outer circumferential surfaces of the closing members 164. This machining operation is effected on a lathe or turning machine such that the blank 160 is held by chucks at the holding portions 202 of the closing members 164, with the blank 160 being centered with two centers engaging the center holes 204, and such that the blank 160 (i.e., an assembly of the body member 162 and the two closing members 164 fitted in the body member 162) is rotated by a suitable rotary drive device through the chucks.

Then, the outer circumferential surfaces of the hollow head sections 170 of the body member 162 and the closing members 164 are coated with a suitable material, such as a film of polytetrafluoroethylene. The blank 160 is then subjected to a machining operation to cut off the holding portions 202 from the outer end faces 200 of the closing members 164, and a centerless grinding operation on the coated outer circumferential surfaces of the hollow head sections 170 and the closing members 164, so that the two portions which provide the head portions 72 of the two pistons 14 are formed. In the next step, a cutting operation is performed near the two bridge portions 182 of the twin engaging section 168, to form the recesses 114 in which the shoes 76 of the pistons 14 are received. Thus, the two portions which provide the engaging portions 70 of the two pistons 14 are formed at the twin engaging section 168. Finally, the twin engaging section 168 is subjected at its axially central portion to a cutting operation to cut the blank 160 into two pieces which provide the respective two single-headed pistons 14.

In the present embodiment wherein the body member 162 is die-cast using the die-casting device which includes the two mold halves 216, 218 and the slide cores 220, 222, the die-cast body member 162 need not be subjected to a machining operation on the inner circumferential surface 171 and the inner bottom surface 176 of each head section 170, resulting in a reduced cost of manufacture of the body member 162. Since the front end of each slide core 220, 222 is formed to have the above-described nonaxisymmetric configuration, each of the formed head sections 170 has, at its inner bottom surface 176, the recess 178 which has been recessed or depressed by the protrusion 252 of the slide core 220, 222 toward the arm section 188. According to this arrangement, the recess 178 is formed at a radially outer portion and a circumferential portion of the inner bottom surface 176 corresponding to the base section 184, so as to reduce the weight of the head portion at the circumferential portion of the inner bottom surface 176, which circumferential portion could not be conventionally subjected to a machining operation using a cutting tool for reducing the weight of the head section. Accordingly, the present arrangement is effective to reduce the weight of the piston 14. In the present embodiment wherein each squeezing member 260 is forced into the molten metal mass in the axial direction from the bottom portion 212 of the head section 170 toward the engaging section 166, the blow holes present in the engaging section 166 which is required to exhibit a particularly high degree of strength can be effectively removed by the pressure applied from the squeezing member 260, whereby the piston 14 to be obtained has a significantly high quality.

Figure 11:
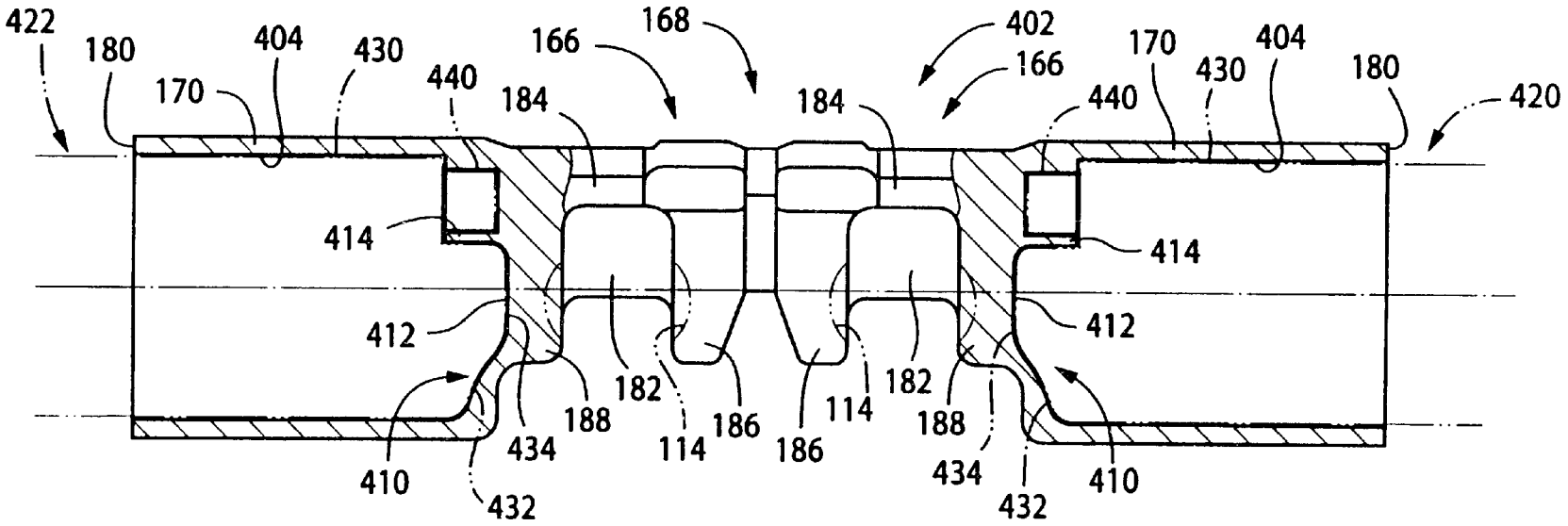
FIG. 11 is a front elevational view partly in cross section of a body member for a swash plate type compressor piston, which body member is constructed according to another embodiment of the present invention.

The front end of the slide core may be formed into any configuration provided that the configuration is nonaxisymmetric with respect to the axis of the slide core. When the squeezing member is provided in the slide core such that the axis of the slide core is aligned with the axis of the slide core as in the illustrated embodiment, the residual wall is left at the central portion of the inner bottom surface of the head section, which can be easily removed by the rotary cutting tool. However, the squeezing member may be provided in the slide core such that the axis of the squeezing member is offset from the axis of the slide core. FIG. 11 shows a body member 402 of the blank for the single-headed piston, which body member 402 is constructed according to another embodiment which uses slide cores and squeezing members different from those used for producing the body member 162 shown in FIG. 5. In FIG. 11, the same reference numerals as used in the embodiment of FIGS. 1–10 are used to identify the corresponding components, and a detailed description of which is dispensed with.

In the body member 402 of FIG. 11, each cylindrical hollow head section 170 has an inner circumferential surface 404 having a constant diameter, and an inner bottom surface 410 having a three-dimensional configuration nonaxisymmetric with respect to the centerline of the head section 170. Described in detail, a radially central portion of the bottom wall of the hollow head section 170 has a recess 412 formed in its inner surface, so as to reduce the weight of the head section 170 at its bottom. The dimensions of the recess 412 as measured in directions parallel and perpendicular to the centerline of the head section 170 (perpendicular and parallel to the direction of extension of the arm section 188), is smaller than those of the arm section 188. The depth of the recess 412 as measured in the direction parallel to the centerline of the head section 170 is determined such that the recess 412 does not reach the recess 114 in which the shoe 76 of the piston 14 is received. At a radially outer portion and a circumferential portion of the inner bottom surface 410 which corresponds to the base section 184, there is formed a hollow cylindrical residual wall 414 which protrudes from the bottom surface 410 in the direction parallel to the centerline of the head section 170.

Within the mold halves 216, 218 of the die-casting device used in the present embodiment, a pair of slide cores 420, 422 are positioned such that the slide cores 420, 422 are slidably movable relative to the mold halves 216, 218 in the direction parallel to the centerline of the head section 170. Like the slide cores 220, 222 used in the first embodiment, each slide core 420, 422 of this embodiment is moved between an advanced position and a retracted position by a slide core drive device not shown.

Figure 12:
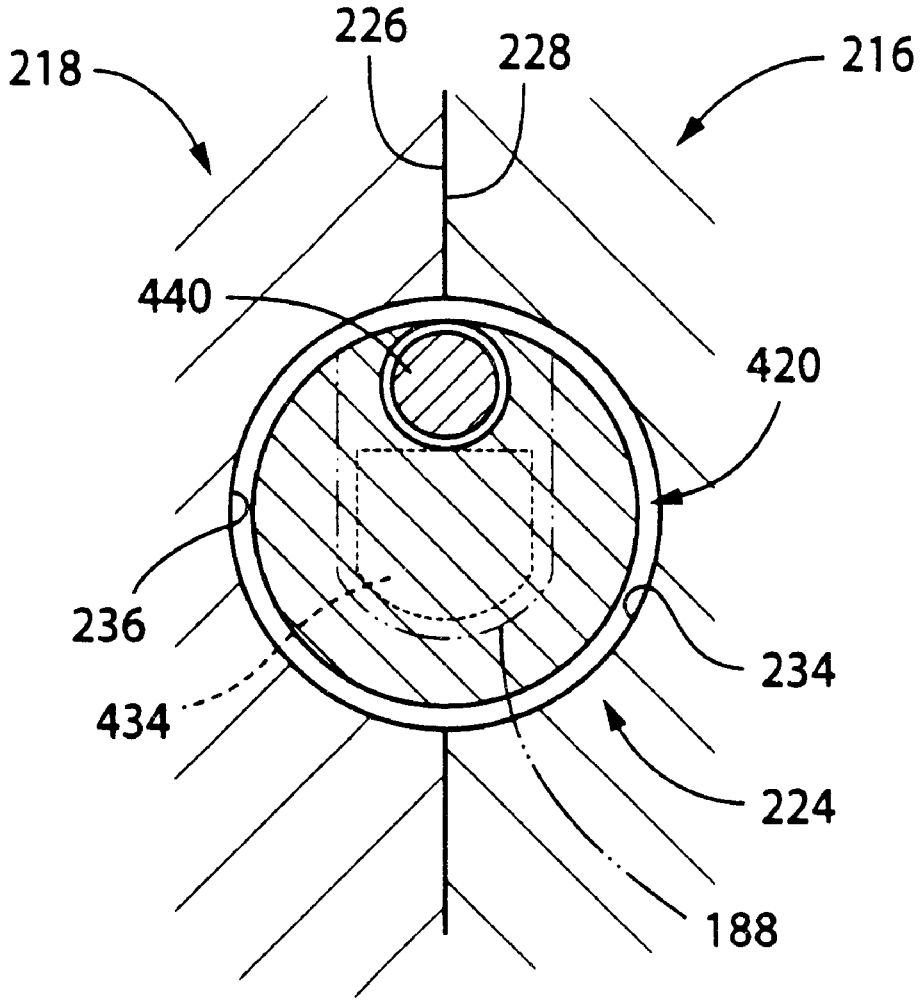
FIG. 12 is a side elevational view in cross section of a die-casting device used in the die-casting process for producing the body member of FIG. 11.

The front end of each slide core 420, 422 has a configuration nonaxisymmetric with respect to its axis so as to give the three-dimensional configuration of the inner bottom surface 410 of the head section 170 of the body member 402. Each slide core 420, 422 has a cylindrical portion whose outer circumferential surface 430 has a diameter corresponding to that of the inner circumferential surface 404 of the head section 170, and the front end portion whose end face 432 is formed with a protrusion 434 which protrudes from a central portion of the end face 432 in the axial direction toward the arm section 188 of the engaging section 166. As shown in FIG. 12, the dimensions of the protrusion 434 of the slide core 420, 422 as measured in directions parallel and perpendicular to the centerline of the head section 170 is smaller than those of the arm section 188. Within the slide cores 420, 422, a pair of squeezing members 440, 440 are provided such that the squeezing members 440 are slidably movable relative to the slide cores 420, 422 in the direction parallel to the axis of the slide cores 420, 422. Each squeezing member 440 is positioned at a radially outer portion and a circumferential portion of each slide core 420, 422 which are located radially outwardly of the protrusion 434 and correspond to the base section 184 of the engaging section 166. The squeezing member 440 has a structure similar to that of the squeezing member 260 of the first embodiment, and is moved by a squeezing member drive device not shown. The body member 402, which is die-cast by using the die-casting device including the slide cores 420, 422 and the squeezing members 440 constructed as described above, has a reduced weight owing to the recess 412 formed in the inner bottom surfaces 410 of the head sections 170. In the present embodiment, each squeezing member 440 is forced at its front end portion into the molten metal mass corresponding to the base section 184 of the engaging section 166, so that the blow holes in the base section 184 of the engaging section 166 can be effectively eliminated. The residual wall 414 formed as a result of a squeezing operation by the squeezing member 440 at the radially outer portion of the inner bottom surface 410 of each head section 170 may or may not be cut off.

In the illustrated embodiments, two pieces of the single-headed piston 14 can be produced from a single blank, for thereby reducing the cost of die-casting the piston 14. However, a single piston may be produced from a blank which includes one body member and one closing member.

In the illustrated embodiments, the closing members are produced by die-casting. The closing members may be produced by any other method such as forging. When the closing members have a simple configuration, the closing members may be produced by effecting a machining operation on an ordinary cylindrical member which is commercially available. The configuration of the closing members is not particularly limited. For instance, the closing members may be a circular plate.

The parting plane which is defined by the two mold halves 216, 218 of the casting mold 215 used for die-casting the blank for the two single-headed pistons may be otherwise established. For instance, the parting plane may be parallel to a plane which includes a centerline of the blank 160 passing the centers of the head sections 170 and which is perpendicular to the direction of extension of the arm sections 186, 188 from the base sections 184. In this case, the parting plane passes a part of the engaging sections 166 which has the largest dimension as measured in the direction perpendicular to the direction of extension the arm sections 186, 188.

The closing members may be welded to the body member of the blank for the piston by means of a laser beam. Alternatively, the closing members and the body member may be bonded together by any suitable means other than the beam welding. For instance, the closing members are fixed to the body member by bonding using an adhesive agent or an alloy having a lower melting point than those members, such as a soldering or brazing material. Further, the closing members may be fixed to the body member by caulking or by means of screws. Alternatively, the closing members may be fixed to the body member by utilizing frictional contact or plastic material flow between the two members.

In the illustrated embodiments, the body member and the closing members are formed of an aluminum alloy. However, these members may be formed of other metallic material such as a magnesium alloy.

The construction of the swash plate type compressor for which the piston 14 is incorporated is not limited to that of FIG. 1. For instance, the solenoid-operated control valve 90 is not essential, and the compressor may use a shut-off valve which is mechanically opened and closed depending upon a difference between the pressures in the crank chamber 86 and the discharge chamber 24. In place of or in addition to the solenoid-operated control valve 90, a solenoid-operated control valve similar to the control valve 90 may be provided in the bleeding passage 100. Alternatively, a shut-off valve may be provided, which is mechanically opened or closed depending upon a difference between the pressures in the crank chamber 86 and the suction chamber 22.

While some presently preferred embodiments of this invention have been described above, for illustrative purpose only, it is to be understood that the present invention may be embodied with various changes and improvements such as those described in the SUMMARY OF THE INVENTION, which may occur to those skilled in the art.

What is claimed is:

1. A method of producing a body member of a piston for a swash plate type compressor, said body member including a generally hollow cylindrical head section having a closed end and an open end which is closed by a closing member so as to provide a head portion of said piston, and an engaging section which is formed integrally with a bottom portion of said hollow cylindrical head section which is located at said closed end, said engaging section giving an engaging portion of said piston for engagement with a swash plate of the compressor, comprising the steps of:

preparing a die-casting device including a casting mold consisting of: two mold halves which are spaced apart from each other and butted together in a direction perpendicular to a centerline of said hollow cylindrical head section, said two mold halves having respective molding surfaces; and a slide core which is slidably movable in a direction parallel to said centerline such that said slide core is advanced into and retracted from said casting mold, said slide core cooperating with said molding surfaces of said mold halves to define therebetween a mold cavity when said slide core is advanced into said casting mold, said mold cavity having a configuration following that of said body member which includes said hollow cylindrical head section and said engaging section, at least a front end portion of said slide core having a nonaxisymmetric configuration with respect to a centerline of said slide core; and die-casting said body member using said die-casting device, such that said hollow cylindrical head section has an inner bottom surface having a three-dimensional configuration which is nonaxisymmetric with respect to said centerline of said hollow cylindrical head section corresponding to said nonaxisymmetric configuration of said front end portion of said slide core.

2. A method according to claim 1, wherein said engaging section is a generally U-shaped section having a base section which extends, in a direction substantially parallel to said centerline of said head section, from a predetermined circumferential portion of said bottom portion of said head section, said circumferential portion being offset from said centerline of said head section, and a pair of parallel arm sections which extend from said base section in the direction substantially perpendicular to said centerline of said head section, said slide core being formed with a protrusion which protrudes, in the direction parallel to said centerline of said head section, from a predetermined circumferential portion of said front end of said slide core which corresponds to said base section of said engaging section.

3. A method according to claim 1, wherein said slide core is provided with a squeezing member which is slidably movable in the direction parallel to said centerline of said head section, said step of die-casting said body member comprising forcing an end portion of said squeezing member into a molten metal which fills said mold cavity to give said body member, whereby blow holes present in said molten metal are removed.

4. A method according to claim 3, wherein said squeezing member is formed concentrically with said slide core so as to press a central portion of said inner bottom surface of said head section.

5. A method according to claim 4, further comprising a step of: subjecting said body member formed by die-casting to a machining operation to cut off a hollow residual wall which is formed at said central portion of said inner bottom surface of said head section, as a result of an operation of said squeezing member, said machining operation comprising rotating a rotary cutting tool and said body member relative to each other about said centerline of said head section.

6. A method according to claim 1, wherein said step of die-casting said body member comprises die-casting two body members each having said engaging section and said head section, said two body members being connected to each other at their ends on the side of said engaging sections, such that said head sections of said two body members are concentric with each other, and such that each of said head sections of said two body members is open at one of its opposite ends which is remote from said engaging sections which are connected together.

7. A method according to claim 1, wherein said step of die-casting said body member is effected according to a pore-free die-casting method.

8. A method according to claim 7, wherein said hollow cylindrical head section has a wall thickness of not larger than 1.8 mm.

9. A method of producing a piston for a swash plate type compressor having a body member, said body member including a generally hollow cylindrical head section having a closed end and an open end which is closed by a closing member so as to provide a head portion of said piston, and an engaging section which is formed integrally with a bottom portion of said hollow cylindrical head section which is located at said closed end, said engaging section giving an engaging portion of said piston for engagement with a swash plate of the compressor, comprising the steps of:

preparing a die-casting device including a casting mold consisting of: two mold halves which are spaced apart from each other and butted together in a direction perpendicular to a centerline of said hollow cylindrical head section, said two mold halves having respective molding surfaces; and a slide core which is slidably movable in a direction parallel to said centerline such that said slide core is advanced into and retracted from said casting mold, said slide core cooperating with said molding surfaces of said mold halves to define therebetween a mold cavity when said slide core is advanced into said casting mold, said mold cavity having a configuration following that of said body member which includes said hollow cylindrical head section and said engaging section, at least a front end portion of said slide core having a nonaxisymmetric configuration with respect to a centerline of said slide core;

die-casting said body member according to a pore-free die-casting method by using said die-casting device, such that said hollow cylindrical head section has an inner bottom surface having a three-dimensional configuration which is nonaxisymmetric with respect to said centerline of said hollow cylindrical head section corresponding to said nonaxisymmetric configuration of said front end portion of said slide core; and closing said hollow cylindrical head section of said body member at said open end by said closing member to provide said head portion of said piston, without effecting a machining operation on an inner circumferential surface of said head section.

* * * * *